US010952298B1

(12) United States Patent
Yang et al.

(10) Patent No.: US 10,952,298 B1
(45) Date of Patent: Mar. 16, 2021

(54) LED QUICK ACTIVATION SYSTEM

(71) Applicant: XIAMEN LEEDARSON LIGHTING CO., LTD, Fujian (CN)

(72) Inventors: Shihhsueh Yang, Fujian (CN); Chunchieh Kuo, Fujian (CN); Yihsiung Lin, Fujian (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 16/998,899

(22) Filed: Aug. 20, 2020

(30) Foreign Application Priority Data

Sep. 25, 2019 (TW) ..... 108134653

(51) Int. Cl.
*H05B 45/30* (2020.01)
*H05B 45/37* (2020.01)

(52) U.S. Cl.
CPC ..... *H05B 45/30* (2020.01)

(58) Field of Classification Search
CPC ..... H05B 45/30; H05B 45/37; H05B 45/50; H02M 3/07; H02M 3/33507; H02M 2001/322
See application file for complete search history.

(56) References Cited

U.S. PATENT DOCUMENTS 10,082,251 B1 * 9/2018 Deng ..... H05B 45/3575
2012/0139422 A1 * 6/2012 Ren ..... H05B 45/37 315/126
2015/0311803 A1 * 10/2015 Schaemann ..... H02M 1/12 315/210
2015/0312989 A1 * 10/2015 Wee ..... H05B 47/19 315/113
2016/0081156 A1 * 3/2016 Kim ..... H05B 45/48 315/210

* cited by examiner

*Primary Examiner* — Thai Pham
(74) *Attorney, Agent, or Firm* — Chun-Ming Shih; Lanway IPR Services

(57) ABSTRACT

A LED quick activation system includes a driving circuit, a loading module, a filter capacitor, a current control switch, a quick discharging module and a primary controller. The primary controller records a preceding discharging parameter that the filter capacitor requires to discharge its cross voltage from a target charging voltage to the loading module's LED unit's barrier voltage. The primary controller calculates an equivalent charging period of charging the filter capacitor's cross voltage to the target charging voltage using the discharging parameter. The primary controller controls the current control switch to charge the filter capacitor and the loading module using the driving current of a charging amplitude during the equivalent charging period. The primary controller charges the filter capacitor and the loading module using the driving current of a regular amplitude after the equivalent charging period passes.

20 Claims, 5 Drawing Sheets

LED QUICK ACTIVATION SYSTEM

FIELD

The present invention relates to a light-emitting diode (LED) quick activation system, and more particularly, to a LED quick activation system capable of rapidly charging its filter capacitor and being substantially free from feedback voltage detection.

BACKGROUND

As technology develops and white light-emitting diode (LED) comes out with a breakthrough, LEDs have been applied on various types of household appliances. On top of that, since LEDs' high efficiency in illumination, they are replacing conventional incandescent lamps and fluorescent lamps in the market.

For improving a conventional LED unit's illuminating stability, the conventional LED unit is mounted with a capacitor that has a large capacitance at its driving circuit's output stage. Therefore, while under a low luminance (i.e., a low-amplitude current), the conventional LED's driving circuit will take too long a period to illuminate itself because of its capacitor's large capacitance. And it is highly likely to mislead its user that said conventional LED unit is malfunctioning. As a matter of fact, the conventional LED unit's operational voltage characteristics are the actual factor of the long activation period. Specifically, before the capacitor charges itself for successfully activating the conventional LED unit, the conventional LED unit has been overpowered but its operational voltage still stays within its cutoff zone, such that said conventional LED unit cannot rapidly activate itself under such a condition.

SUMMARY

The present disclosure aims at disclosing a light-emitting diode (LED) quick activation system that includes a driving circuit, a loading module, a filter capacitor, a current control switch, a quick discharging module and a primary controller. The driving circuit generates a driving voltage and a driving current using a received power. The loading module is electrically coupled to the driving circuit. Also, the loading module illuminates its LED unit using the driving voltage and the driving current. The filter capacitor is electrically coupled to the loading module in parallel. In addition, the filter capacitor charges its cross voltage using the driving voltage or discharge its cross voltage to ground. The current control switch is electrically coupled to the driving circuit for receiving the driving circuit. Moreover, the current control switch controls input power to the loading module and the filter capacitor. The quick discharging module is electrically coupled to the loading module and the filter capacitor in parallel. Besides, the quick discharging module aids in the filter capacitor's discharging to a ground level. The primary controller is electrically coupled to the driving circuit, the current control switch and the quick discharging module. And the primary controller records a preceding discharging parameter that the filter capacitor requires to discharge its cross voltage from a target charging voltage to the loading module's LED unit's barrier voltage. Additionally, the primary controller calculates an equivalent charging period of charging the filter capacitor's cross voltage to the target charging voltage using the discharging parameter. Furthermore, the primary controller controls the current control switch to charge the filter capacitor and the loading module using the driving current of a charging amplitude during the equivalent charging period. Last, the primary controller charges the filter capacitor and the loading module using the driving current of a regular amplitude after the equivalent charging period passes. The target charging voltage refers to a lower-bound voltage that successfully drives the loading module.

In one example, the quick discharging module includes a first controller, a second controller, a logic gate, a counter and a discharging unit. The first controller is electrically coupled to the driving circuit for receiving the driving voltage. The second controller is electrically coupled to the filter capacitor's output terminal for detecting the filter capacitor's cross voltage. The logic gate is respectively and electrically coupled to the first controller and the second controller for receiving respective output control signals. The counter is electrically coupled in between the first controller and the logic gate. The discharging unit is electrically coupled to the loading module in parallel.

In one example, the first controller compares the driving voltage with a built-in predetermined voltage that corresponds to a lower-bound voltage that can drive the driving module's normal operations. When the first controller confirms that the driving voltage is higher than the predetermined voltage in voltage level, the first controller outputs a high-level voltage to the counter. And the counter in turn keeps on resetting the counter's count and outputs a first logic parameter that corresponds to the high-level voltage to the logic gate's first input terminal. The second controller senses the filter capacitor's cross voltage that exceeds the target charging voltage. Also, the second controller correspondingly generates a second logic parameter that corresponds to the filter capacitor's cross voltage to the logic gate's second input terminal. The logic gate performs a logic calculation on both the first logic parameter and the second logic parameter to keep the discharging unit open-circuit. Such that the driving voltage keeps on charging the filter capacitor and the loading module.

In one example, the first controller compares the driving voltage with a built-in predetermined voltage that corresponds to a lower-bound voltage that can drive the driving module's normal operations. When the first controller confirms that the driving voltage drops below the predetermined voltage, the first controller outputs a low-level voltage to the counter. The counter in turn accumulates its count as a clock. Additionally, the counter outputs a third logic parameter to the logic gate's first input terminal. The filter capacitor begins discharging its cross voltage during the counter's accumulation in its count. Such that the second controller senses the filter capacitor's cross voltage and correspondingly generates a second logic parameter. The logic gate performs logic calculation on both the third logic parameter and the second logic parameter. Moreover, the logic gate in turn activates the discharging unit. The activated discharging unit discharges the filter capacitor.

In one example, when the discharging unit discharges the filter capacitor to a ground level, the primary controller stores the counter's final count as a discharging parameter. The primary controller also estimates an estimated charging period of the filter capacitor based on the discharging parameter.

In one example, the current switch includes a constant current source and an equivalent transistor.

In one example, the primary controller calculates the target charging voltage as:

V_target=V_C×X. V_target indicates target charging voltage, V_C indicates the loading module's LED barrier voltage, and X indicates a charging end ratio.

In one example, the primary controller calculates a required discharging period of the filter capacitor as:

T_Ron=S_th/F_sw=M. T_Ron and M indicate the discharging period, S_th indicates the counter's final count, and F_sw indicates a power transformation switch frequency.

In one example, the primary controller calculates a charging voltage that the filter capacitor's cross voltage can reach during the same period as the discharging period as:

V_(C,TRon)=(M)×I_in/C. V_(C,TRon) indicates the charging voltage, M indicates the discharging period, I_in indicates the driving current from the driving circuit, and C indicates the filter capacitor CF's capacitance.

In one example, the primary controller calculates a charging period, during which the charging voltage takes to charge till reaching the target charging voltage, as:

T_Roff=(V_target-V_(C,TRon))×I_in/C. T_Roff indicates the charging period, V_(C,TRon) indicates the charging voltage, V_target indicates the target charging voltage, I_in indicates the driving current from the driving circuit, and C indicates the filter capacitor CF's capacitance.

In one example, the primary controller calculates the equivalent charging period as a sum of the discharging period and the charging period.

In one example, the primary controller calculates the equivalent charging period as:

T=T_Ron+T_Roff=M+[(V_C×X)−(M×I_in/C)×I_in/C]. T indicates the equivalent charging period, T_Ron and M indicate the discharging period, T_Roff indicates the charging period, V_C indicates the loading module's LED barrier voltage, X indicates a charging end ratio, I_in indicates the driving current from the driving circuit, and C indicates the filter capacitor CF's capacitance.

In one example, the current switch comprises a constant resistor and an equivalent transistor.

In one example, the primary controller calculates the target charging voltage as: V_target=V_C×X. V_target indicates target charging voltage, V_C indicates the loading module's LED barrier voltage, and X indicates a charging end ratio.

In one example, the primary controller calculates a required discharging period of the filter capacitor as:

T_Ron=S_th/F_sw=M. T_Ron and M indicate the discharging period, S_th indicates the counter's final count, and F_sw indicates a power transformation switch frequency.

In one example, the primary controller calculates a charging voltage that the filter capacitor's cross voltage can reach during the same period as the discharging period as:

V_(C,TRon)=(I_in×M/C)/(1+M/RC). V_(C,TRon) indicates the charging voltage, M indicates the discharging period, I_in indicates the driving current from the driving circuit, C indicates the filter capacitor CF's capacitance, and R indicates the constant resistor's resistance.

In one example, the primary controller calculates a charging period, during which the charging voltage takes to charge till reaching the target charging voltage, as:

T_Roff=(V_target-V_(C,TRon))×I_in/C. T_Roff indicates the charging period, V_(C,TRon) indicates the charging voltage, V_target indicates the target charging voltage, I_in indicates the driving current from the driving circuit, and C indicates the filter capacitor CF's capacitance.

In one example, the primary controller calculates the equivalent charging period as a sum of the discharging period and the charging period.

In one example, the primary controller calculates the equivalent charging period as:

T=T_Ron+T_Roff=M+[(V_C×X)−((I_in×M/C)/(1+M/RC))×I_in/C]. T indicates the equivalent charging period, T_Ron and M indicate the discharging period, T_Roff indicates the charging period, V_C indicates the loading module's LED barrier voltage, X indicates a charging end ratio, I_in indicates the driving current from the driving circuit, C indicates the filter capacitor CF's capacitance, and R indicates the constant resistor's resistance.

In one example, the primary controller is implemented using at least one or a combination of a central processing unit (CPU), a programmable unit microprocessor that is for general use or specific use, a digital signal processor (DSP), and an application specific integrated circuits (ASIC).

In one example, the primary controller further includes a storage unit for permanently or quasi-permanently storing information that includes a lookup table or multiple sets of operating parameters or pre-storing operating parameters.

DETAILED DESCRIPTION

As mentioned above, the present disclosure discloses a LED quick activating system for substantially neutralizing the conventional LED unit's defect in its capacitor's long charge period. Specifically, the disclosed LED quick activating system is capable of rapidly charging its filter capacitor under a low luminance/a low-amplitude current. Moreover, the disclosed LED quick activation system is substantially free of voltage detection. Therefore, the disclosed LED quick activation system has lower standby power consumption and a simpler circuitry.

Figure 1:
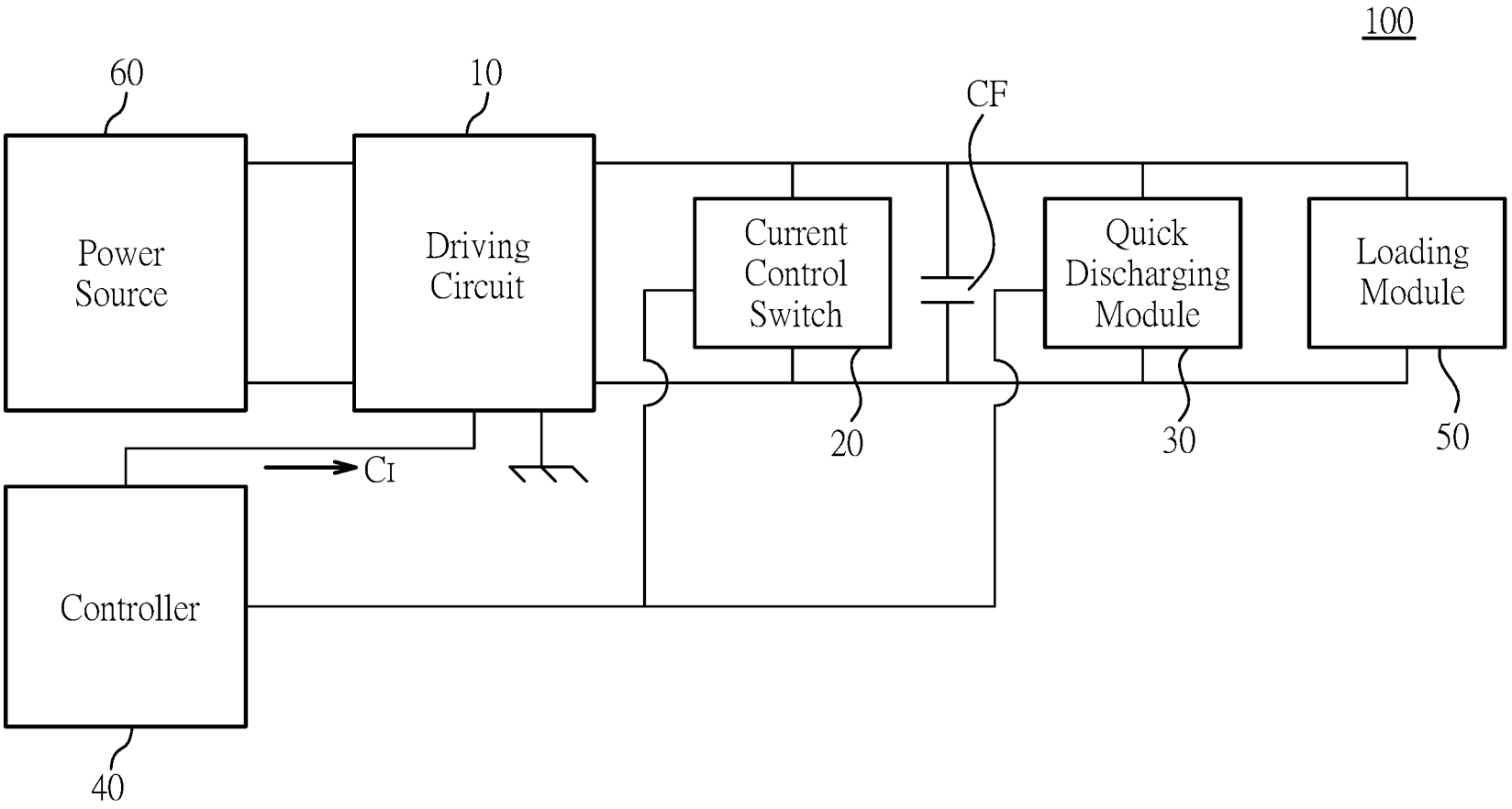
FIG. 1 illustrates a schematic diagram of a LED quick activation system according to one embodiment.

FIG. 1 illustrates a schematic diagram of a LED quick activation system 100 according to one embodiment. In some examples, the LED quick activation system 100 is equipped on a LED device for rapidly driving the LED device to its qualified operational voltage from a standby or cold-start status, i.e., in an extremely short of period.

The LED quick activation system 100 includes a driving circuit 10, a current control switch 20, a quick discharging module 30, a controller 40, a loading module 50, a power source 60 and a filter capacitor CF.

The driving circuit 10 is electrically coupled to the power source 60 for receiving power. Also, the driving circuit is electrically coupled to the loading module 50 and the filter capacitor CF in parallel for driving the loading module 50 using a driving current and for charging the filter capacitor CF. In some examples, the power source 60 provides a direct-current (DC) voltage or an alternative-current (AC) voltage. In addition, in some examples, the driving circuit 10 includes at least one or a combination of a transformer, a rectifier, a filter, and other circuits or devices having similar functions.

The current control switch 20 is electrically coupled to the driving circuit 10 for receiving its driving current. Second, the current control switch 20 is electrically coupled to the controller 40 for receiving a current control signal CI that renders the current control switch 20 to switch on or switch off. Third, the current control switch 20 is electrically coupled to the loading module 50 and the filter capacitor CF in parallel for controlling their input power. Specifically, the current control switch 20 uses pulse-width modulation (PWM) for modulating an input period (or an input frequency) and in turn determines the output power for the loading module 50 and the filter capacitor CF.

The quick discharging module 30 is electrically coupled to the loading module 50 and the filter capacitor CF in parallel. Also, the quick discharging module 30 rapidly switches the loading module 50 to ground. And the quick discharging module 30 linearly discharges the filter capacitor with the aid of a constant-current false-loading design. Such that the filter capacitor CF's discharging period is significantly reduced. The quick discharging module 30's technical details will be introduced later.

The controller 40 is electrically coupled to the driving circuit 10, the current control switch 20 and the quick discharging module 30 for controlling these elements' respective operations. In some examples, the controller 40 is implemented using at least one or a combination of a central processing unit (CPU), a programmable unit microprocessor that is for general use or specific use, a digital signal processor (DSP), and an application specific integrated circuits (ASIC). In some examples, the controller 40 may be equipped with a storage unit or be combined with the storage unit to form a system-on-chip (SoC) chip. Such that the controller 40 is capable of permanently or quasi-permanently storing information, which may include a lookup table or multiple sets of operating parameters. And in turn the controller 40 can pre-store required operating parameters for future access or use.

Primarily, the controller 40 records discharging parameters generated during a preceding period that the quick discharging module 30 discharges the filter capacitor CF. In this way, the controller 40 determines an equivalent charging period for the loading module 50's operational voltage parameters. In addition, based on the determined equivalent charging period, the controller 40 transmits the current control signal CI to the current control switch 20 for switching the input power to the loading module 50 and the filter capacitor CF. During the equivalent charging period (i.e., under a first mode), the controller 40 transmits the current control signal CI to the current control switch 20 for outputting a high-power charging current to charge the filter capacitor CF. After the equivalent charging period passes (i.e., under a second mode), the controller 40 immediately transmits another current control signal CI to the current control switch 20 for switching its output current to a regular charging current that then charges the loading module 50 and the filter capacitor CF.

Figure 2:
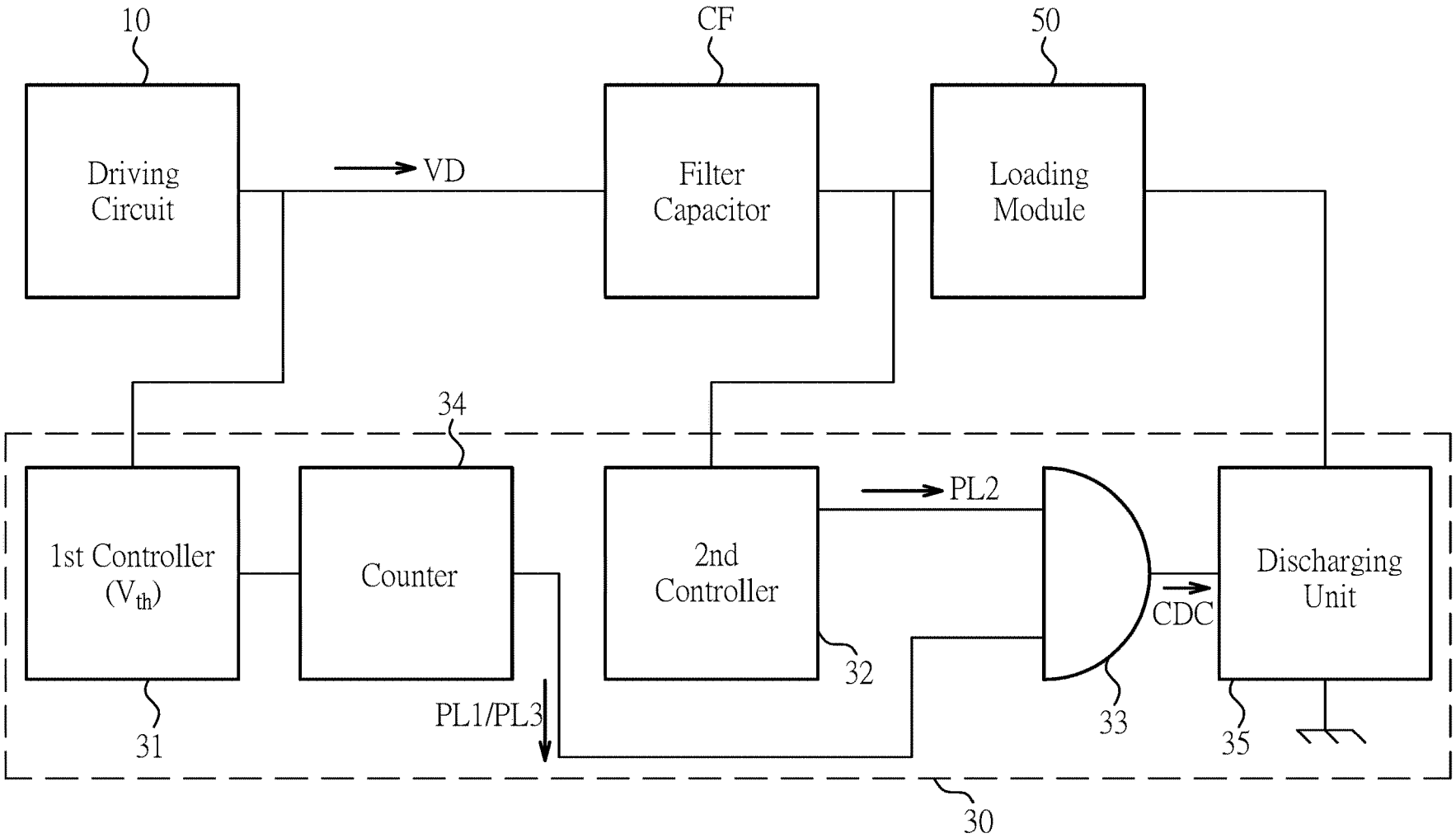
FIG. 2 illustrates a detailed diagram of how FIG. 1's LED quick activation system's quick discharging module interacts with the LED quick activation system's driving circuit, filter capacitor and loading module according to one example.

FIG. 2 illustrates a detailed diagram of how the quick discharging module 30 interacts with the driving circuit 10, the filter capacitor CF and the loading module 50 according to one example. The quick discharging module 30 includes a first controller 31, a second controller 32, a logic gate 33, a counter 34 and a discharging unit 35.

The first controller 31 is electrically coupled to the driving circuit 10 for receiving its output driving voltage VD. The second controller 32 is electrically coupled to the filter capacitor CF's output terminal for detecting the filter capacitor CF's cross voltage. The logic gate 33 is respectively and electrically coupled to the first controller 31 and the second controller 32 for receiving respective output control signals. The counter 34 is electrically coupled in between the first controller 31 and the logic gate 33. The discharging unit 35 is electrically coupled to the loading module 50 in parallel.

In some examples, the first controller 31 and the second controller 32 are implemented as respectively independent SoC chips or both integrated with the controller 40 as a SoC chip. Besides, in some examples, the logic gate 33 is implemented using an AND gate, an OR gate, a NAND gate, or a NOR gate. In some other examples, the logic gate 33's circuitry is altered to various embodiments, for example, by increasing a number of used logic gates and/or inverters, or by modifying its counter's triggering condition.

After the driving circuit 10 is activated, the first controller 31 compares the driving circuit 10's output voltage VD with a built-in predetermined voltage Vth, which indicates a lower-bound voltage that can drive the loading module 50's normal operations. When the output voltage VD is higher than the predetermined voltage Vth in voltage level, the first controller 31 outputs a high-level voltage, which is generated by applying a built-in Schmitt trigger's voltage swing, to the counter 34. Upon receiving the high-level voltage, the counter 34 keeps on resetting its count and outputs a first logic parameter PL1 to the logic gate 33's first input terminal. At this time, the second controller 32 senses the filter capacitor CF's high cross voltage, which is charged by via the output voltage VD, and in response outputs a second logic parameter PL2 to the logic gate 33's second input terminal. And the logic gate 33 performs logic calculation on both the received first logic parameter PL1 and the received second logic parameter PL2 to generate a control signal CDC to keep the discharging unit 35 open-circuit. At this time, the driving circuit 10's output voltage VD keeps on charging the filter capacitor CF and the loading module 50.

Upon the moment when the driving circuit 10 is switched off such that its output voltage VD's voltage level significantly drops below the predetermined voltage Vth, the first controller 31 compares the driving circuit 10's output voltage VD with the predetermined voltage Vth. At this time, the output voltage VD's voltage level is lower than the predetermined voltage Vth's voltage level, such that the first controller 31 outputs a low-level voltage, which is generated by the built-in Schmitt trigger's voltage swing, to the counter 34. At this time, the counter 34's return pin's voltage level is changed from high to low, so the counter 34 starts accumulating its count as a clock. When the counter 34's count exceeds a predetermined upper count, the counter 34 outputs a third logic parameter PL3 to the logic gate 33's first input terminal. At the same time, since the filter capacitor CF hasn't begun discharging itself during the counter 34's counting, the second controller 32 still senses the filter capacitor CF's high cross voltage and keeps on outputting the second logic parameter PL2. Therefore, the logic gate 33 currently receives the third logic parameter PL3 from the counter 34 (i.e., the first controller 31) and the second logic parameter PL2 from the second controller 32. And in turn, the logic gate 33 outputs the control signal CDC to activate (i.e., close-circuit) the discharging unit 35. Such that the discharging unit 35 rapidly discharges the filter capacitor CF to a low level (e.g., the ground level).

At the end of discharging the filter capacitor CF, the counter 34's final count is stored as a discharging parameter by the controller 40. Additionally, the controller 40 is capable of estimating the filter capacitor CF's required charging period based on the stored discharging parameter without referring to a feedback voltage. The present disclosure discloses two examples of ow the discharging parameter is determined in FIG. 3 and FIG. 4 in a form of equivalent circuit diagram.

Figure 3:
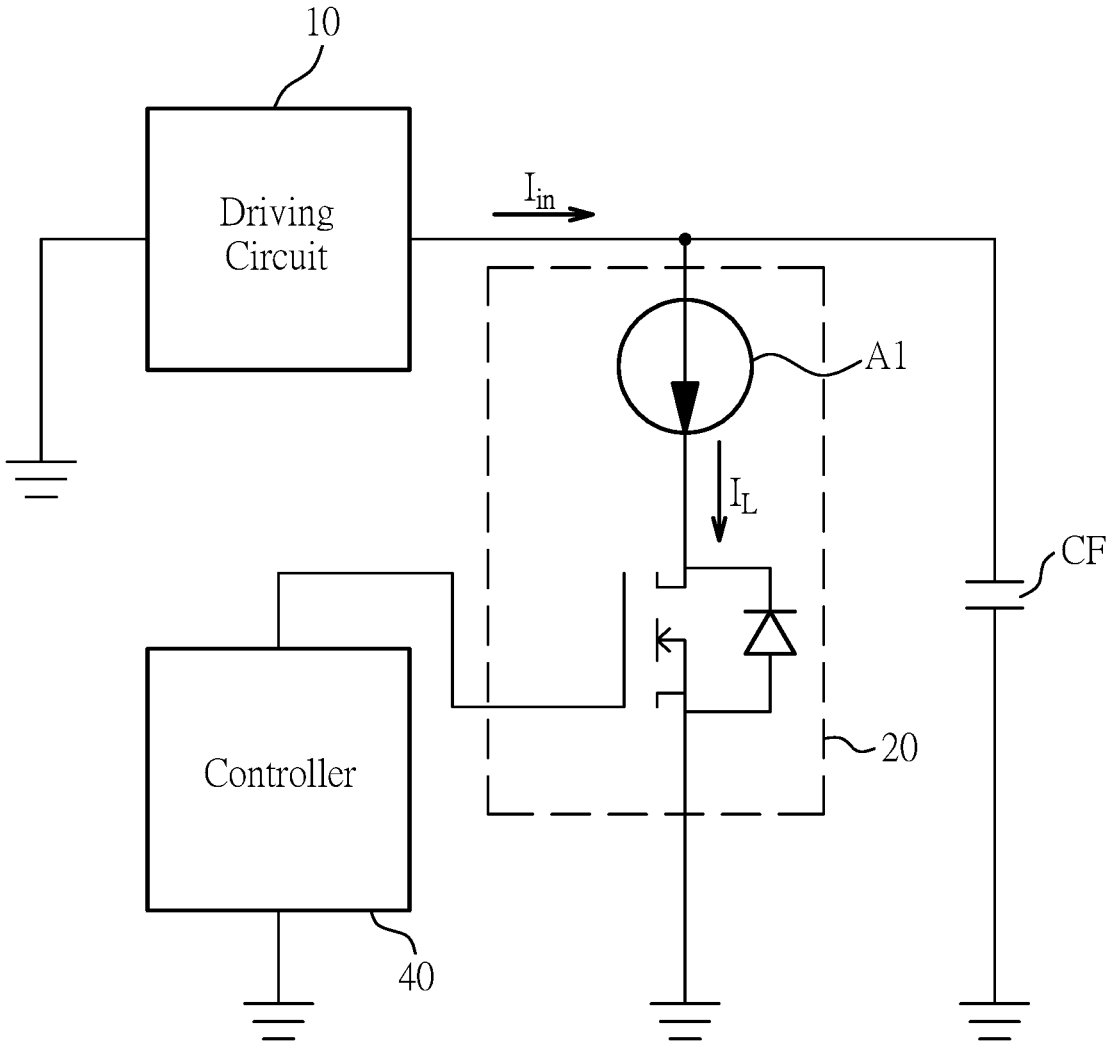
FIG. 3 and FIG. 4 illustrate equivalent circuit diagrams of how FIG. 1's LED quick activation system's controller determines a discharging parameter.

As shown in FIG. 3, the current control switch 20 includes a constant current source A1 and an equivalent transistor. After an initial discharging, the controller 40 confirms a discharging parameter S_th/F_sw, where S_th indicates the counter 34's final count, and F_sw indicates a power transformation switch frequency. With the aid of circuitry setting, the following parameters are known: V_C indicates a LED's barrier voltage (from the loading module 50), X indicates a charging end ratio, I_in indicates a charging current or the driving current from the driving circuit 10, I_L indicates the constant current source A1's constant current, and C indicates the filter capacitor CF's capacitance.

At initial, a designated target charging voltage V_target, using which the filter capacitor CF's cross voltage reaches at least (i.e., lower-bound) for successfully driving the loading module 50, has to be determined. The controller 40 calculates a target charging voltage V_target as:

$$V_\text{target}=V_C\times X \quad (1);$$

Second, the controller 40 calculates the discharging parameter S_th/F_sw and define said discharging parameter S_th/F_sw as a required discharging period T_Ron, during which the filter capacitor CF discharges to the LED's barrier voltage V_C. The controller 40 calculates the discharging period T_Ron as:

$$T_R\text{on}=S_th/F_sw=M \quad (2);$$

It is noted that the discharging period T_Ron can be replaced by other characteristic parameters in other examples.

Third, the controller 40 calculates a charging voltage V_(C,TRon) that the filter capacitor CF's cross voltage can reach during the same period as the discharging period T_Ron as:

$$V_(C,TR\text{on})=(M)\times I_\text{in}/C \quad (3);$$

Fourth, the controller 40 calculates a charging period T_Roff, during which the charging voltage V_(C,TRon) takes to charge till reaching the target charging voltage V_target, as:

$$T_R\text{off}=(V_\text{target}-V_(C,TR\text{on}))\times I_\text{in}/C \quad (4);$$

Last, the controller 40 calculates an equivalent charging period T, during which the filter capacitor CF requires to charge, as a sum of the discharging period T_Ron and the charging period T_Roff, i.e., as:

$$T=T_R\text{on}+T_R\text{off}=M+[(V_C\times X)-(M\times I_\text{in}/C)\times I_\text{in}/C] \quad (5).$$

Figure 4:
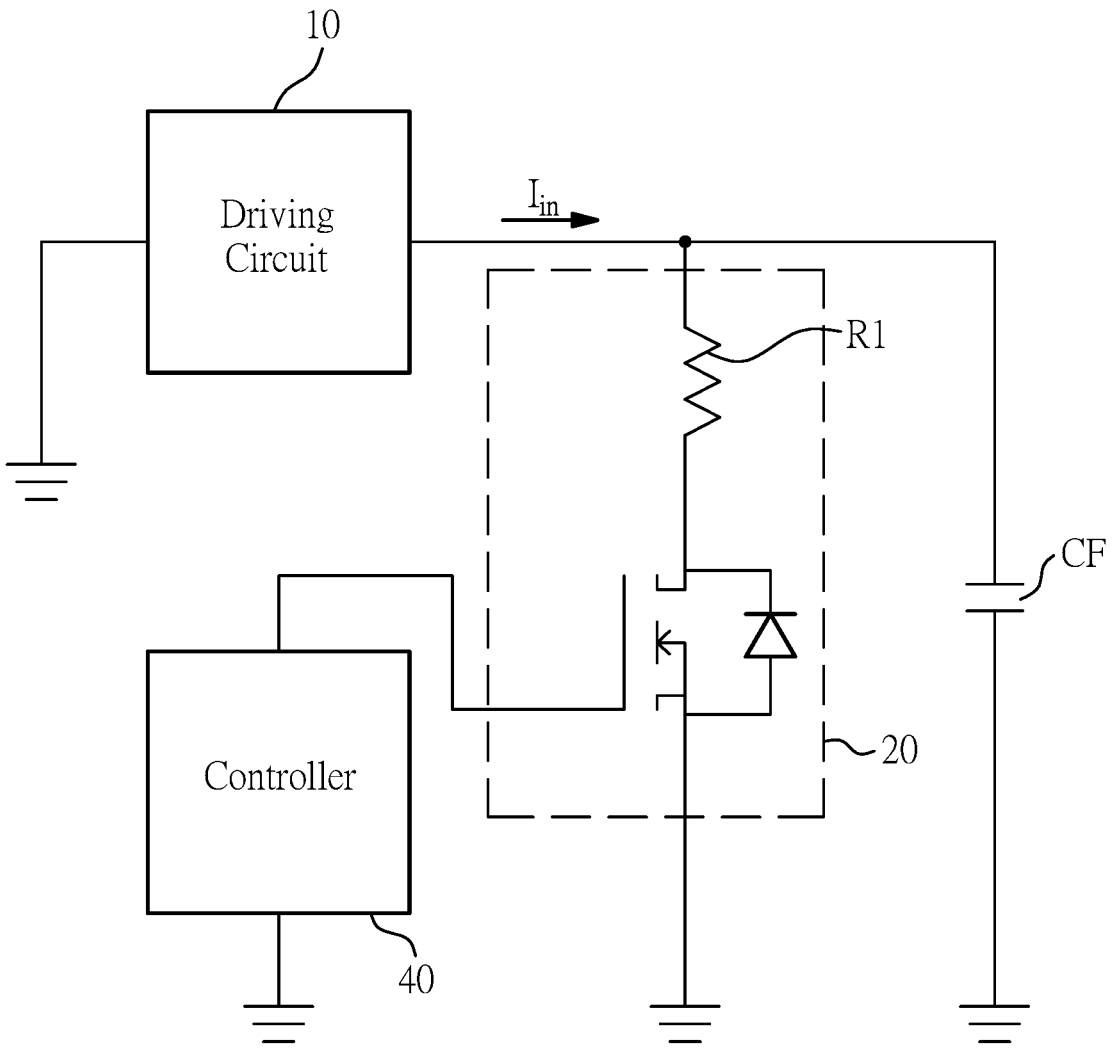

In another example, as shown in FIG. 4, the current control switch 20 includes a constant resistor R1 and an equivalent transistor. After an initial discharging, the controller 40 confirms the discharging parameter S_th/F_sw, where S_th and F_sw shares same definitions as abovementioned. Similarly, with the aid of circuitry setting, the following parameters are also known: V_C indicates the LED's barrier voltage (from the loading module 50), X indicates the charging end ratio, I_in indicates the charging current, I_L indicates the constant current source A1's constant current, C indicates the filter capacitor CF's capacitance, and R indicates the constant resistor R1's resistance.

At initial, the designated target charging voltage V_target, which the filter capacitor CF's cross voltage at least (i.e., lower-bound) reaches for successfully driving the loading module 50, has to be determined. The controller 40 calculates the target charging voltage V_target as:

$$V_\text{target}=V_C\times X \quad (6);$$

Second, the controller 40 calculates the discharging parameter S_th/F_sw and define said discharging parameter S_th/F_sw as the required discharging period T_Ron, during which the filter capacitor CF discharges to the LED's barrier voltage V_C. The controller 40 calculates the discharging period T_Ron as:

$$T_R\text{on}=S_th/F_sw=M \quad (7);$$

It is noted that the discharging period T_Ron can be replaced by other characteristic parameters in other examples.

Third, the controller 40 calculates a charging voltage V_(C,TRon) that the filter capacitor CF's cross voltage can reach during the same period as the discharging period T_Ron as:

$$V_(C,TR\text{on})=(I_\text{in}\times M/C)/(1+M/RC) \quad (8);$$

Fourth, the controller 40 calculates the charging period T_Roff, during which the charging voltage V_(C,TRon) takes to charge till reaching the target charging voltage V_target, as:

$$T_R\text{off}=(V_\text{target}-V_(C,TR\text{on}))\times I_\text{in}/C \quad (9);$$

Last, the controller 40 calculates an equivalent charging period T, during which the filter capacitor CF requires to charge, as a sum of the discharging period T_Ron and the charging period T_Roff, i.e., as:

$$T=T_R\text{on}+T_R\text{off}=M+[(V_C\times X)-((I_\text{in}\times M/C)/(1+M/RC))\times I_\text{in}/C] \quad (10).$$

With the aid of the first example (i.e., formulas (1)-(5)) and the second example (i.e., formulas (6)-(10)), the controller 40 is capable of calculating the filter capacitor CF's required charging period T. Based on the charging period T, the controller 40 can operate under two different charging modes. Under a first mode that corresponds to the equivalent charging period T, the driving circuit 10 that is under the controller 40's control charges the filter capacitor CF with a high-power charging current. And under a second mode that after the equivalent charging period T passes, the driving circuit 10 that is under the controller 40's control switches to a regular charging current for charging the loading module 50 and the filter capacitor CF. Such that the controller 40 is able to immediately activate the loading module 50, specifically, its LED units.

Figure 5:
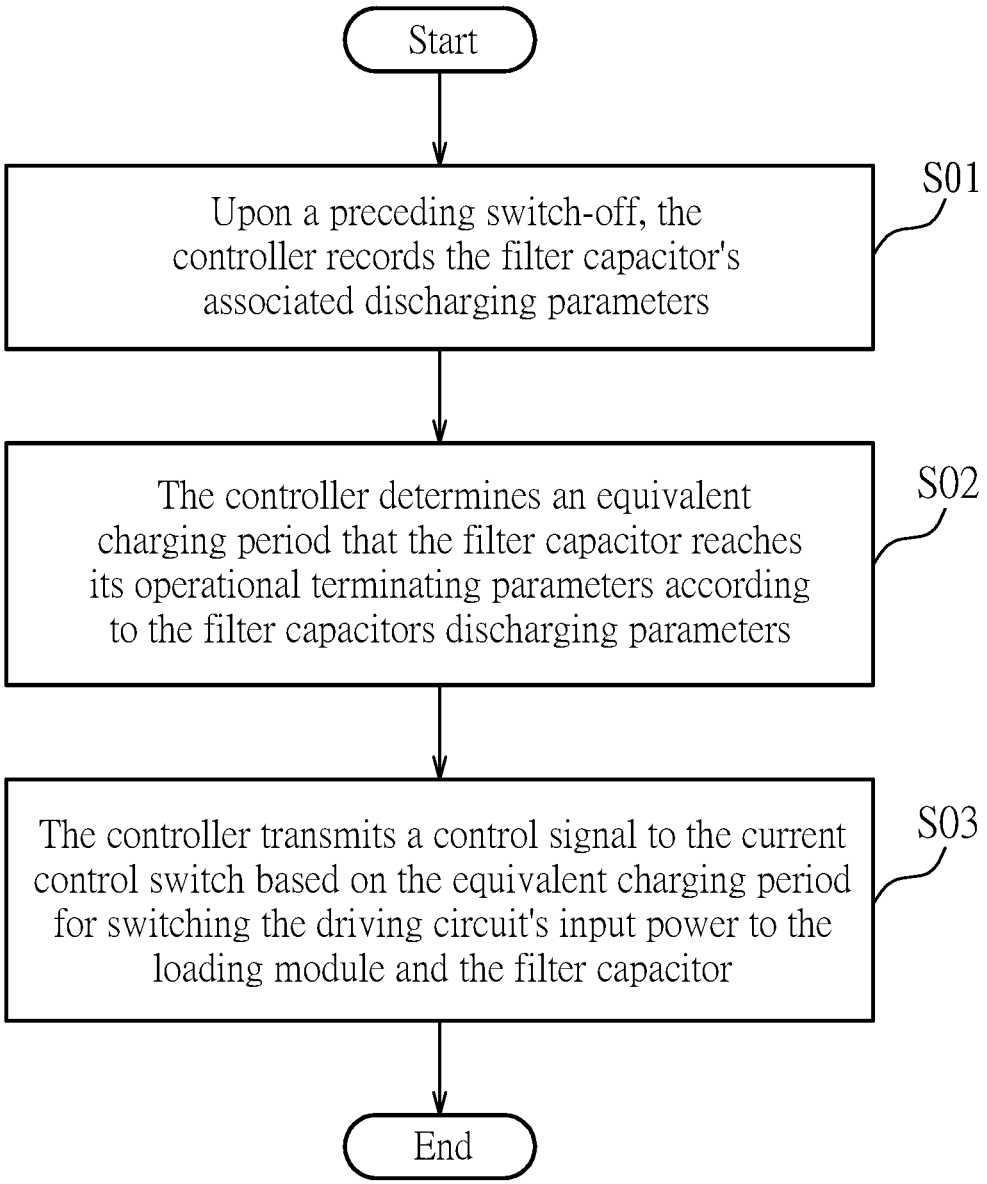
FIG. 5 illustrates a flowchart of a quick activation method that the LED quick activation system shown in FIG. 1 applies according to one embodiment.

FIG. 5 illustrates a flowchart of a quick activation method that the LED quick activation system 100 applies according to one embodiment. In some examples, the disclosed quick activation method in a form of software or firmware is installed in a processor for execution. The disclosed quick activation method may also be implemented using multiple chips and their circuitry.

In Step 501, during a preceding switch-off of the LED quick activation system 100, the controller records a discharging parameter, which may be the filter capacitor CF's discharging period, the counter 34's count, or other parameters that are positively associated with the filter capacitor CF's discharging period.

In Step S02, the controller 40 determines the equivalent charging period T according to the filter capacitor CF's discharging parameter. During the equivalent charging period T, the controller 40's calculation may vary corresponding to different types of circuitry. In Step S03, the controller 40 transmits the control signal CI to the current control switch 20 for switching the driving circuit 10's input power to the loading module 50 and the filter capacitor CF. Specifically, the controller 40 switches between the above-mentioned first and second modes. During the first mode, i.e., during the equivalent charging period T, the controller 40 relays the current control signal CI of a first level to the current control switch 20 for outputting a high-power charging current (i.e., of a charging amplitude) to charge the filter capacitor CF. During the second mode, i.e., after the equivalent charging period T passes, the controller 40 relays the current control signal CI of a second level to the current control switch 20 for switching to output a regular-power current (i.e., of a regular amplitude) for charging the loading module 50 and the filter capacitor CF. Based on the switching between the first mode and the second mode, the LED quick activation system 100 is capable of charging the filter capacitor CF's cross voltage to the extent that the loading module 50 can normally operate (i.e., the loading module 50's LED units to normally illuminate) in a significantly short period. Such that the LED quick activation system 100 can perform its quick-start function.

In summary, the disclosed LED activation system 100 can rapidly charge its filter capacitor CF upon the driving circuit 10 switches from an OFF state to an ON state. In this way, even though the disclosed LED activation system 100 receive a low-amplitude current, it still activates the loading module 50's LED units in a significantly short period. On top of that, the disclosed LED activation system 100 is substantially free from detecting a feedback voltage for required control. Therefore, the disclosed LED activation system 100 has the following advantages: (1) the controller 40's less pins; (2) no voltage-dividing resistor is required; (3) no regular power consumption caused by detecting the feedback voltage occurs; (4) lower standby power consumption (because of substantially free from feedback voltage detection); and (5) the disclosed LED activation system 100's simpler circuitry.

The invention claimed is:

1. A light-emitting diode (LED) quick activation system, comprising:

a driving circuit, configured to generate a driving voltage and a driving current using a received power;

a loading module, electrically coupled to the driving circuit, and configured to illuminate its LED unit using the driving voltage and the driving current;

a filter capacitor, electrically coupled to the loading module in parallel, and configured to charge its cross voltage using the driving voltage or discharge its cross voltage to ground;

a current control switch, electrically coupled to the driving circuit for receiving the driving circuit, and configured to control input power to the loading module and the filter capacitor;

a quick discharging module, electrically coupled to the loading module and the filter capacitor in parallel, and configured to aid in the filter capacitor's discharging to a ground level; and a primary controller, electrically coupled to the driving circuit, the current control switch and the quick discharging module, configured to record a preceding discharging parameter that the filter capacitor requires to discharge its cross voltage from a target charging voltage to the loading module's LED unit's barrier voltage, configured to calculate an equivalent charging period of charging the filter capacitor's cross voltage to the target charging voltage using the discharging parameter, configured to control the current control switch to charge the filter capacitor and the loading module using the driving current of a charging amplitude during the equivalent charging period, and configured to charge the filter capacitor and the loading module using the driving current of a regular amplitude after the equivalent charging period passes;

wherein the target charging voltage refers to a lower-bound voltage that successfully drives the loading module.

2. The LED quick activation system of claim 1, wherein the quick discharging module comprises:

a first controller, electrically coupled to the driving circuit for receiving the driving voltage;

a second controller, electrically coupled to the filter capacitor's output terminal for detecting the filter capacitor's cross voltage;

a logic gate, respectively and electrically coupled to the first controller and the second controller for receiving respective output control signals;

a counter, electrically coupled in between the first controller and the logic gate; and a discharging unit, electrically coupled to the loading module in parallel.

3. The LED quick activation system of claim 2, wherein the first controller is further configured to compare the driving voltage with a built-in predetermined voltage that corresponds to a lower-bound voltage that can drive the driving module's normal operations;

wherein when the first controller confirms that the driving voltage is higher than the predetermined voltage in voltage level, the first controller is further configured to output a high-level voltage to the counter, and the counter is further configured to in turn keep on resetting the counter's count and output a first logic parameter that corresponds to the high-level voltage to the logic gate's first input terminal;

wherein the second controller is further configured to sense the filter capacitor's cross voltage that exceeds the target charging voltage, and is further configured to correspondingly generate a second logic parameter that corresponds to the filter capacitor's cross voltage to the logic gate's second input terminal; and wherein the logic gate is further configured to perform a logic calculation on both the first logic parameter and the second logic parameter to keep the discharging unit open-circuit, such that the driving voltage keeps on charging the filter capacitor and the loading module.

4. The LED quick activation system of claim 2, wherein the first controller is further configured to compare the driving voltage with a built-in predetermined voltage that corresponds to a lower-bound voltage that can drive the driving module's normal operations;

wherein when the first controller confirms that the driving voltage drops below the predetermined voltage, the first controller is further configured to output a low-level voltage to the counter;

wherein the counter is further configured to in turn accumulate its count as a clock, and is further configured to output a third logic parameter to the logic gate's first input terminal;

wherein the filter capacitor is further configured to begin discharging its cross voltage during the counter's accumulation in its count, such that the second controller is further configured to sense the filter capacitor's cross voltage and correspondingly generate a second logic parameter;

wherein the logic gate is further configured to perform logic calculation on both the third logic parameter and the second logic parameter, and is further configured to in turn activate the discharging unit; and wherein the activated discharging unit is further configured to discharge the filter capacitor.

5. The LED quick activation system of claim 4, wherein when the discharging unit discharges the filter capacitor to a ground level, the primary controller is further configured to store the counter's final count as a discharging parameter; and wherein the primary controller is further configured to estimate an estimated charging period of the filter capacitor based on the discharging parameter.

6. The LED quick activation system of claim 5, wherein the current switch comprises a constant current source and an equivalent transistor.

7. The LED quick activation system of claim 6, wherein the primary controller is further configured to calculate the target charging voltage as:

$$V_\text{target}=V_C\times X;$$

wherein V_target indicates target charging voltage, V_C indicates the loading module's LED barrier voltage, and X indicates a charging end ratio.

8. The LED quick activation system of claim 7, wherein the primary controller is further configured to calculate a required discharging period of the filter capacitor as:

$$T_R\text{on}=S_th/F_sw=M;$$

wherein T_Ron and M indicate the discharging period, S_th indicates the counter's final count, and F_sw indicates a power transformation switch frequency.

9. The LED quick activation system of claim 8, wherein the primary controller is further configured to calculate a charging voltage that the filter capacitor's cross voltage can reach during the same period as the discharging period as:

$$V_(C,TR\text{on})=(M)\times I_\text{in}/C;$$

wherein V_(C,TRon) indicates the charging voltage, M indicates the discharging period, I_in indicates the driving current from the driving circuit, and C indicates the filter capacitor CF's capacitance.

10. The LED quick activation system of claim 9, wherein the primary controller is further configured to calculate a charging period, during which the charging voltage takes to charge till reaching the target charging voltage, as:

$$T_R\text{off}=(V_\text{target}-V_(C,TR\text{on}))\times I_\text{in}/C;$$

wherein T_Roff indicates the charging period, V_(C, TRon) indicates the charging voltage, V_target indicates the target charging voltage, I_in indicates the driving current from the driving circuit, and C indicates the filter capacitor CF's capacitance.

11. The LED quick activation system of claim 10, wherein the primary controller is further configured to calculate the equivalent charging period as a sum of the discharging period and the charging period.

12. The LED quick activation system of claim 11, wherein the primary controller is further configured to calculate the equivalent charging period as:

$$T=T_R\text{on}+T_R\text{off}=M+[(V_C\times X)-(M\times I_\text{in}/C)\times I_\text{in}/C];$$

wherein T indicates the equivalent charging period, T_Ron and M indicate the discharging period, T_Roff indicates the charging period, V_C indicates the loading module's LED barrier voltage, X indicates a charging end ratio, I_in indicates the driving current from the driving circuit, and C indicates the filter capacitor CF's capacitance.

13. The LED quick activation system of claim 5, wherein the current switch comprises a constant resistor and an equivalent transistor.

14. The LED quick activation system of claim 13, wherein the primary controller is further configured to calculate the target charging voltage as:

$$V_\text{target}=V_C\times X$$

wherein V_target indicates target charging voltage, V_C indicates the loading module's LED barrier voltage, and X indicates a charging end ratio.

15. The LED quick activation system of claim 14, wherein the primary controller is further configured to calculate a required discharging period of the filter capacitor as:

$$T_R\text{on}=S_th/F_sw=M;$$

wherein T_Ron and M indicate the discharging period, S_th indicates the counter's final count, and F_sw indicates a power transformation switch frequency.

16. The LED quick activation system of claim 15, wherein the primary controller is further configured to calculate a charging voltage that the filter capacitor's cross voltage can reach during the same period as the discharging period as:

$$V_(C,TR\text{on})=(I_\text{in}\times M/C)/(1+M/RC);$$

wherein V_(C,TRon) indicates the charging voltage, M indicates the discharging period, I_in indicates the driving current from the driving circuit, C indicates the filter capacitor CF's capacitance, and R indicates the constant resistor's resistance.

17. The LED quick activation system of claim 16, wherein the primary controller is further configured to calculate a charging period, during which the charging voltage takes to charge till reaching the target charging voltage, as:

$$T_R\text{off}=(V_\text{target}-V_(C,TR\text{on}))\times I_\text{in}/C$$

wherein T_Roff indicates the charging period, V_(C, TRon) indicates the charging voltage, V_target indicates the target charging voltage, I_in indicates the driving current from the driving circuit, and C indicates the filter capacitor CF's capacitance.

18. The LED quick activation system of claim 17, wherein the primary controller is further configured to calculate the equivalent charging period as a sum of the discharging period and the charging period.

19. The LED quick activation system of claim 18, wherein the primary controller is further configured to calculate the equivalent charging period as:

$$T=T_R\text{on}+T_R\text{off}=M+[(V_C\times X)-((I_\text{in}\times M/C)/(1+M/RC))\times I_\text{in}/C],$$

wherein T indicates the equivalent charging period, T_Ron and M indicate the discharging period, T_Roff indicates the charging period, V_C indicates the loading module's LED barrier voltage, X indicates a charging end ratio, I_in indicates the driving current from the driving circuit, C indicates the filter capacitor CF's capacitance, and R indicates the constant resistor's resistance.

20. The LED quick activation system of claim 1, wherein the primary controller is implemented using at least one or a combination of a central processing unit (CPU), a programmable unit microprocessor that is for general use or specific use, a digital signal processor (DSP), and an application specific integrated circuits (ASIC).

* * * * *